US009371694B2

(12) United States Patent
Hearn et al.

(10) Patent No.: US 9,371,694 B2
(45) Date of Patent: Jun. 21, 2016

(54) PERMANENT BYPASS WHIPSTOCK ASSEMBLY FOR DRILLING AND COMPLETING A SIDETRACK WELL AND PRESERVING ACCESS TO THE ORIGINAL WELLBORE

(75) Inventors: David D. Hearn, Houston, TX (US); Lamar L. Gantt, Anchorage, AK (US); Dan E. Venhaus, Chugiak, AK (US); John G. Eller, Anchorage, AK (US)

(73) Assignee: ConocoPhillips Company, Houston, TX (US)

( * ) Notice: Subject to any disclaimer, the term of this patent is extended or adjusted under 35 U.S.C. 154(b) by 263 days.

(21) Appl. No.: 12/796,370

(22) Filed: Jun. 8, 2010

(65) Prior Publication Data

US 2010/0307736 A1 Dec. 9, 2010

Related U.S. Application Data

(60) Provisional application No. 61/184,930, filed on Jun. 8, 2009.

(51) Int. Cl.

| | |
|---|---|
| ***E21B 7/08*** | (2006.01) |
| ***E21B 29/06*** | (2006.01) |
| ***E21B 7/06*** | (2006.01) |
| ***E21B 41/00*** | (2006.01) |

(52) U.S. Cl.
CPC ..... *E21B 7/061* (2013.01); *E21B 29/06* (2013.01); *E21B 41/0035* (2013.01)

(58) Field of Classification Search
USPC ..... 166/117.5, 50, 242.3; 175/61
See application file for complete search history.

(56) References Cited

U.S. PATENT DOCUMENTS

| | | | | |
|---|---|---|---|---|
| 5,311,936 | A | 5/1994 | McNair et al. | |
| 5,875,847 | A * | 3/1999 | Forsyth | E21B 41/0042 166/313 |
| 5,964,287 | A * | 10/1999 | Brooks | 166/117.6 |
| 5,979,560 | A | 11/1999 | Nobileau | |
| 6,019,173 | A * | 2/2000 | Saurer | E21B 7/061 166/117.6 |
| 6,047,774 | A * | 4/2000 | Allen | E21B 7/061 166/117.5 |
| 6,056,059 | A * | 5/2000 | Ohmer | 166/313 |
| 6,065,543 | A | 5/2000 | Gano et al. | |
| 6,089,320 | A * | 7/2000 | LaGrange | E21B 41/0042 166/117.5 |
| 6,158,513 | A * | 12/2000 | Nistor et al. | 166/313 |
| RE37,867 | E | 10/2002 | Gondouin | |
| 6,712,144 | B2 * | 3/2004 | Buytaert | 166/313 |
| 6,863,126 | B2 * | 3/2005 | McGlothen et al. | 166/242.1 |
| 6,951,252 | B2 * | 10/2005 | Restarick et al. | 166/313 |
| 7,159,661 | B2 * | 1/2007 | Restarick et al. | 166/313 |
| 2005/0230151 | A1 | 10/2005 | McGarian et al. | |
| 2007/0256841 | A1 | 11/2007 | Galloway | |

OTHER PUBLICATIONS

Schlumberger Oilfield Glossary entries for "mill" and "mill out", accessed Sep. 11, 2012 via www.glossary.oilfield.slb.com.*

(Continued)

*Primary Examiner* — Blake Michener
(74) *Attorney, Agent, or Firm* — Boulware & Valoir

(57) ABSTRACT

The present invention relates to drilling lateral wells or sidetrack wells from a primary wellbore to enhance the efficiency and productivity of oil and gas wells.

22 Claims, 3 Drawing Sheets

(56) References Cited

OTHER PUBLICATIONS

"MultiLateral Well Classification Matrix", by Eric Diggins, Shell UK Exploration and Production, Technical Advancement—Multi-Laterals (TAML), Mar. 13-14, 1997, 5 pages.

"New Aspects of Multilateral Well Construction", Jose Fraija, Herve Ohmer, Tom Pulick, Mike Jardon, Mirush Kaja, Ramior Paez, Gabriel P.G. Sotomayor and Kenneth Umdjoro, Oilfield Review, pp. 52-69 (2002).

* cited by examiner

PERMANENT BYPASS WHIPSTOCK ASSEMBLY FOR DRILLING AND COMPLETING A SIDETRACK WELL AND PRESERVING ACCESS TO THE ORIGINAL WELLBORE

CROSS-REFERENCE TO RELATED APPLICATIONS

This application claims priority benefit under 35 U.S.C. Section 119(e) to U.S. Provisional Patent Ser. No. 61/184,930 filed on Jun. 8, 2009 the entire disclosure of which is incorporated herein by reference.

FIELD OF THE INVENTION

The present invention relates to drilling lateral wells or sidetrack wells from a primary wellbore to enhance the efficiency and productivity of oil and gas wells.

BACKGROUND OF THE INVENTION

It is well known that hydrocarbons may be produced from subterranean formations through a well that has been drilled into a hydrocarbon bearing formation. In many circumstances, it is desirable to then drill one or more additional wellbores (often referred to as "laterals") outward from the primary wellbore in an effort to increase the productivity of the well or to access additional hydrocarbons in adjacent formations. This can be an effective and economical way to substantially increase the profitability of a well and to increase the overall recovery of fluids from a single, primary well site and surface installation. These lateral wells may extend outwardly from the primary wellbore for substantial distances (e.g. 2000 feet or more) or may be relatively short "drainholes" which extend only a few feet (e.g. 100 feet or less) into the formation.

During the drilling of a well, it is often necessary, for various reasons, to alter, i.e., sidetrack, the direction of the wellbore. The challenge when drilling laterals is being able to drill precisely on target. Drill rigs are expensive and several extra days of rig time may substantially reduce the profitability of drilling additional laterals. Efficiently drilling laterals, which directly and precisely exit the primary wellbore at the desired location within the wellbore first, requires cutting an opening or a window through heavy casing or liner.

A conventional technique for drilling laterals may involve the setting of a kickoff plug, or the like, in a primary wellbore. A kickoff plug may have a length ranging from about 50 to 500 feet, and may comprise a cement composition. The kickoff plug typically is set in the wellbore by lowering a drillstring or open-ended tubing string to the desired depth and pumping a cement composition into the wellbore. The cement composition is allowed to cure to form a plug. After the cement plug has formed, a drillstring may be used to reinitiate drilling operations. The drillstring and drill bit use the plug to drill in a new direction, so as to thereby deflect the drill string and change the direction in which the drilling proceeds. However, the use of kickoff plugs may be problematic due to the prevention of access to further production of fluids from lower portions of the original wellbore because the cement seals the well at the deviation.

Another conventional method of forming a lateral wellbore uses a whipstock which is inserted into the main wellbore and fixed therein. The whipstock is typically a steel structure that includes a concave, slanted surface along its upper portion arranged to direct anything coming down the wellbore toward one side thereof. In particular, the whipstock forms a guide for gradually directing a cutting device from the main wellbore of the well into and through the wall of the existing wellbore where the new lateral wellbore will be formed or cut. Similar to the kick-off plug method, whipstocks are typically permanently installed. A conventional permanently installed whipstock prevents further access to lower formations below the installed whipstock. Furthermore, wells require some amount of workover to remain productive which is prevented to some degree by the installation of a permanent whipstock. Thus, a whipstock which allows access to further formations and/or production below the whipstock is preferred.

While most whipstocks are permanent, removable whipstocks have been developed, but have not been entirely satisfactory as the process of milling and drilling over the whipstock generally destroys or severely damages the whipstock. The process of removing a whipstock requires hooking the whipstock with a latching device that is accessible from above. The inherent topside location of the latching mechanism makes it vulnerable to the damage caused by the milling bit and it is not uncommon to have considerable delays in pulling out the temporary whipstock.

Furthermore, techniques for drilling windows through the side of a cased wellbore become particularly challenging when the production tubing is considerably smaller than the liner. With extra room in the liner, the milling drillbit tends to jump around on the whipstock and create extra damage to the whipstock and to other parts of the liner, slowing down progress and increasing the risk of problems, especially with respect to the recovery and removal of the whipstock. The issue of small production tubing in a large liner occurs, for example, when the window is well above the bottom of the original borehole and the production tubing is sized so to maintain liquid flow with the gaseous components. It is a significant advantage to use the gas in the production fluids to carry the valuable liquids to the surface and large diameter tubing is known to frustrate that benefit by allowing the gaseous components to bypass the liquids and leave them at the bottom of the tubing.

SUMMARY OF THE INVENTION

In one embodiment of the present invention, there is a process for drilling a sidetrack wellbore from a tailpipe through a liner pipe and into a desired formation, wherein the process comprises installing a permanent bypass whipstock assembly into a section of a length of the tailpipe as part of a production assembly wherein the permanent bypass whipstock assembly is an elongated, generally cylindrical body in close proximity to the liner with a primary path extending from a first end to a second end wherein the tailpipe is releasably connected to the first end and the second end of the primary path through the permanent bypass whipstock assembly and where the permanent bypass whipstock assembly further includes a deviating sidetrack path whereby the deviating sidetrack path diverges from the primary path at an incline for ultimately forming the sidetrack wherein the downhole end of the deviating sidetrack path is along a peripheral side of the permanent bypass whipstock assembly and the uphole end of the deviating sidetrack path is closer to the first end of the permanent bypass whipstock assembly whereby the uphole end of the deviating sidetrack path opens to the primary path of the permanent bypass whipstock assembly; installing the production assembly into a wellbore with the deviating sidetrack path of the permanent bypass whipstock assembly aligned in a predetermined direction with for forming the sidetrack well that may later be drilled;

installing a diverter to close the primary path below the desired location of the sidetrack path wherein the diverter directs tools and other equipment from the primary path within the permanent bypass whipstock assembly to the sidetrack path of the permanent bypass whipstock assembly; installing a milling system, wherein the milling system includes a milling bit at the downhole end of a drill string whereby when the milling system reaches the diverter the path of the milling assembly is deflected onto the deviating sidetrack path whereby the milling system continues along the sidetrack path whereby the milling system forms a window in the liner; removing the milling system; installing a drill system, wherein the drilling system includes a drillbit located at the downhole end of a drill string whereby the drill system runs through the primary path through the permanent bypass whipstock assembly, being diverted onto the deviating sidetrack path by the diverter whereby the drill system reaches the window formed in the liner by the milling system; drilling a sidetrack wellbore with the drill system; removing the drill system; and installing a liner pipe casing into the sidetrack wellbore.

In another embodiment of the present invention, there is a permanent bypass whipstock assembly for forming a sidetrack wellbore, wherein the permanent bypass whipstock assembly comprises an elongated cylindrical body, wherein the elongated cylindrical body includes a first end connected to an uphole end of the tailpipe and a second end connected to a downhole end of the tailpipe, wherein the elongated cylindrical body includes: a primary path running through the elongated cylindrical body, wherein the primary path is slightly offset whereby the primary path is further defined by a thin-walled portion and a thick walled portion, a deviating sidetrack path for forming a sidetrack wellbore diverges from the primary path, wherein the deviating sidetrack path is below a stabilizing portion and above a deflector portion, wherein the deviating sidetrack path diverges at an incline whereby the uphole end of the deviating sidetrack path is closer to the first end of the permanent bypass whipstock assembly and opens to the primary path of the permanent bypass whipstock assembly whereby the downhole end of the deviating sidetrack path is along a peripheral side of the permanent bypass whipstock assembly, a thin-walled portion, wherein the thin-walled portion is elongated running entire downhole length of the permanent bypass whipstock assembly, whereby an interior surface defines the primary path and an exterior surface is in close proximity with the liner; and a thick-walled portion, wherein the thick-walled portion includes: a stabilizing portion, wherein the stabilizing portion is a wedge shaped inverted trough defined by the deviating sidetrack path, wherein an interior surface of the stabilizing portion defines the primary path and an exterior surface of the stabilizing portion is in close proximity with the liner, and a deflector portion, wherein the deflector portion is wedge shaped with an inclined surface defining the lower portion of the deviating sidetrack path, wherein an interior surface of the deflector further defines the primary path and an exterior surface of the deflector is in close proximity with the liner.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Figure 1:
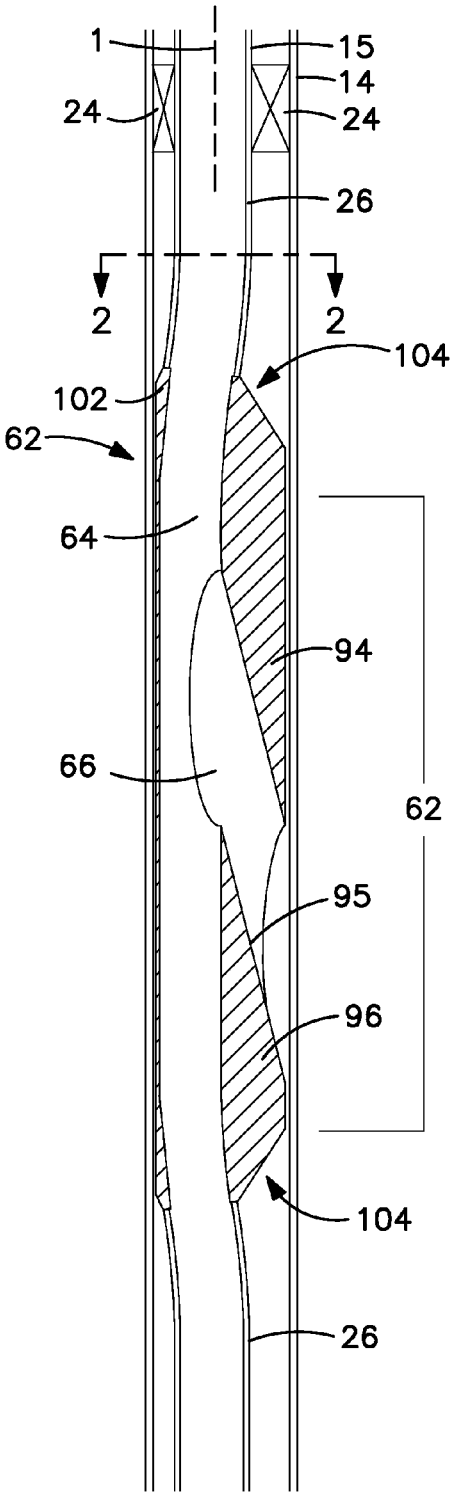
FIG. 1 is a schematic diagram of a primary wellbore.

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations that come within the scope of the appended claims and their equivalents.

In the description which follows, like parts are marked throughout the specification and drawing with the same reference numerals, respectively. The drawing figures are not necessarily to scale and certain features are shown in schematic form or are exaggerated in scale in the interest of clarity and conciseness.

In a conventional drilling operation, a primary wellbore extends into an earth formation for the production of oil and gas. The primary wellbore includes a casing string which is inserted into the wellbore after the wellbore has been drilled. The casing string is generally installed in a wellbore when the well is drilled to target depth or when the sidewalls of the wellbore are in danger of collapsing. If the sidewalls of the wellbore collapse, the wellbore is cased and drilling continues with a smaller drillbit. Once the target is reached, a smaller diameter casing or liner is installed to prevent the sidewalls from collapsing. Typically, once the casing string is installed, cement is forced down the inside of the casing string and up the annulus to seal the casing to the wellbore and prevent fluids from transiting along the wellbore outside of the casing from one formation to another.

A liner is installed within the casing within the primary wellbore. Once a production zone has been reached, a production tubing string is installed within the liner to carry hydrocarbons to the surface where such hydrocarbons are recovered and transported to market. Near the downhole end of the production tubing string, a production packer assembly is installed to seal a production annular space between the liner and the production tubing string in order to prevent fluids from escaping into other parts of the wellbore or formations and to direct the produced fluids into production tubing. Additionally, the production packer assembly ensures the fluids do not flow by the tubing by liner annulus to lower portions of the wellbore.

Referring to FIG. 1, at the downhole end of the production tubing string 15 a production packer assembly 24 is utilized to ensure fluids do not flow down liner 14 to lower portions of the wellbore. At the downhole end of the production tubing string 15 and below production packer assembly 24 is a tailpipe 26.

As previously mentioned, it is sometimes desirable to drill a sidetrack well from within a wellbore. For clarity, it should be understood that conventional wells are drilled substantially vertically from the surface downward to or through the producing formation. However, wellbores may be drilled at a slanted or inclined orientation from the vertical axis. Likewise, deviation may produce a horizontal orientation. Sidetrack wells may extend in any direction from the original well and, in the case of a horizontal wellbore, may extend upward or downward.

Depicted in FIG. 1, tailpipe 26, located at the downhole end of a production tubing string 15 and running below production packer assembly 24, is interrupted by the installation of a permanent bypass whipstock assembly 62, which is utilized to assist in the efficient and economical formation of a sidetrack or lateral well. For demonstrative purposes only, and not by way of limitation, the present illustrated embodiments provide for the use of permanent bypass whipstock assembly 62 to form a sidetrack well which exits liner 14 to the right. Furthermore, for demonstrative purposes only the permanent bypass whipstock assembly is installed below the deepest production packer assembly, however, the permanent bypass whipstock assembly can be installed in the tailpipe below any production packer assembly.

Figure 2:
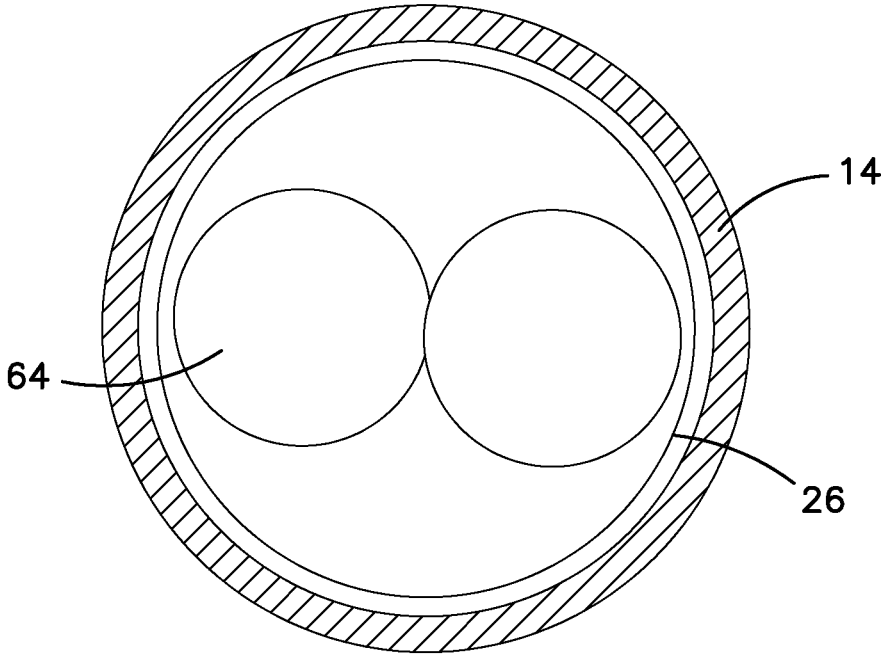
FIG. 2 is a cross-sectional portion of FIG. 1.

In one embodiment, as shown in FIG. 2 which is a cross-section of FIG. 1, permanent bypass whipstock assembly 62 generally has a cylindrical shape with a relatively straight primary path 64 slightly offset from liner axis 1 extending therethrough. Referring back to FIG. 1, permanent bypass whipstock assembly 62 preferably includes a thick robust body constructed of a durable material, such as steel, around primary path 64 and potential sidetrack path 66 to resist forces and pressures, such as drill bits, rotating equipment and other downhole insults, likely imposed as equipment is inserted therethrough.

Permanent bypass whipstock assembly 62 is securely connected to tailpipe 26 at a desired location within the string such that a portion of tailpipe 26 is above permanent bypass whipstock assembly 62 and an additional length of tailpipe 26 extends below permanent bypass whipstock assembly 62. Tailpipe 26 is assembled at the surface with permanent bypass whipstock assembly 62 installed in the desired location and the combined assembly is subsequently installed with the production assembly. In a preferred embodiment, permanent bypass whipstock assembly 62 replaces a section of tailpipe 26 by being screwed or otherwise secured in place. When installed, permanent bypass whipstock assembly 62 is completely open to the path of downhole production, thereby not interfering with the production from the wellbore below the installation of permanent bypass whipstock assembly 62, as shown in FIG. 2.

In an embodiment, permanent bypass whipstock assembly 62 includes several components, a thin-walled portion and a thick walled portion, as shown in FIG. 1. In an embodiment of the present invention, thin-walled portion 102 is an elongated piece running the entire length of permanent bypass whipstock assembly 62. The interior surface of thin-walled portion 102 defines primary path 64, while the exterior surface is in close proximity with liner 14.

Figure 3:
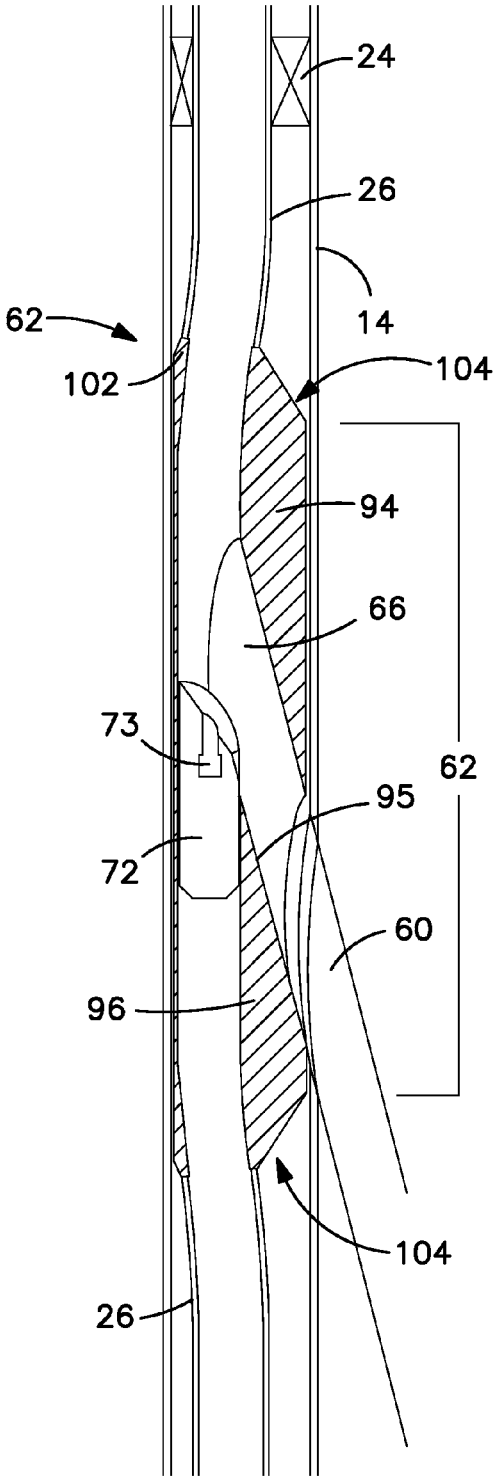
FIG. 3 is detailed cross-sectional side view of a permanent bypass whipstock assembly inserted into a primary wellbore.
Figure 4:
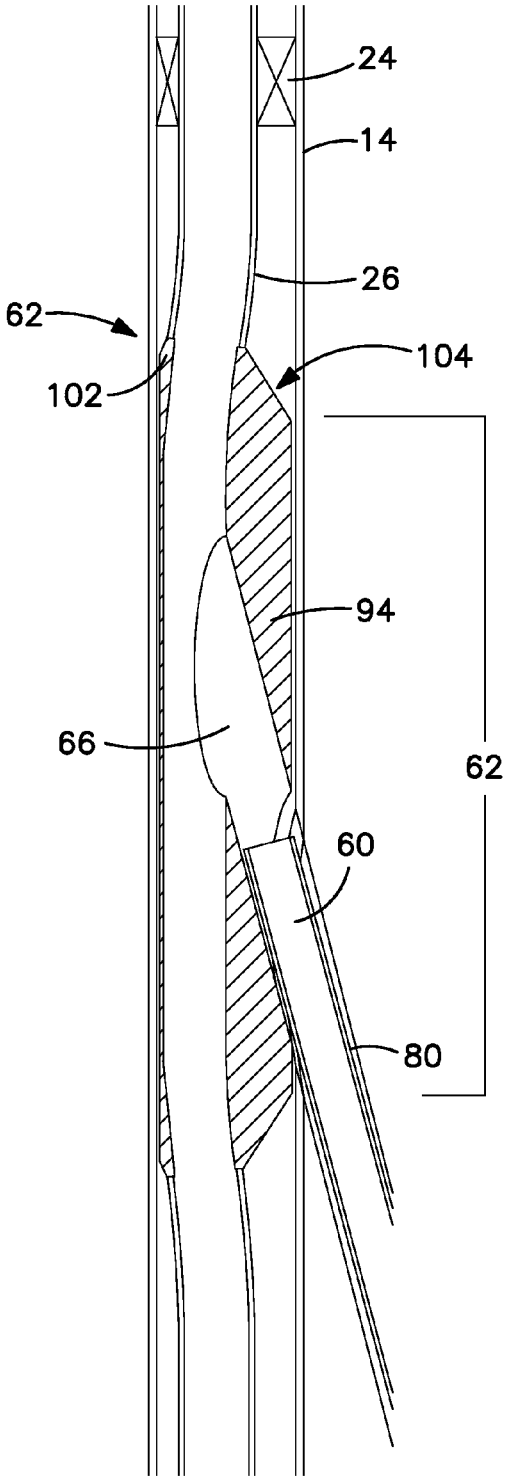
FIG. 4 is a cross-sectional view of the liner, tailpipe and permanent bypass whipstock assembly.

In another embodiment of the present invention, thick-walled portion 104 is located along the peripheral surface opposite thin-walled portion 102. Unlike thin-walled portion 102, thick-walled portion 104 includes sidetrack path 66, a whipstock portion 96, and an optional stabilizing portion 94. Sidetrack path 66, located above whipstock portion 96, provides an inclined path by a sidetrack well is ultimately formed. In an alternate embodiment of the present invention, sidetrack path 66 is located below optional stabilizing portion 94 and above whipstock portion 96 in an effort to provide a path for the formation of a sidetrack well. Sidetrack path 66, as shown in FIGS. 1, 3 and 4, appears to have an angle which is more substantial and dramatic than would perhaps be preferred. The exaggerated or more dramatic angle is drawn so that the angle may be more easily seen by the reader. In the preferred embodiment, the permanent bypass whipstock assembly is quite long and the sidetrack path is also relatively long compared to what is shown in FIG. 3. The preferred angle is between 1.5 to 3 degrees.

Referring to FIG. 3, whipstock portion 96 is a wedge shaped member with an inclined surface 95 defining the lower surface of sidetrack path 66. The inclined surface of whipstock portion 96 follows the natural incline of sidetrack path 66. The interior wall of whipstock portion 96 follows the natural slightly curved path of tailpipe 26 providing a guiding mechanism for the formation of sidetrack well 60. Additionally, the interior wall of whipstock portion 96 defines primary path 64 of permanent bypass whipstock assembly 62. The exterior wall of whipstock portion 96 is in close proximity to the wall of liner 14.

In an alternate embodiment of the present invention, an optional stabilizing portion 94, can be installed above sidetrack path 66. Optional stabilizing portion 94 can have a wedge shape with an inverted trough defined by the upper surface sidetrack path 66, which follows the natural incline of sidetrack 66. The interior wall of stabilizing portion 94 defines primary path 64, following the natural curvature of tailpipe 26 which tailpipe 26 would have followed had it not been interrupted by the insertion of stabilizing portion 94. The exterior wall of stabilizing portion 94 is also in close proximity to the wall of liner 14.

Referring to FIG. 3, when it is desired to create sidetrack well 60, a retrievable diverter 72 is inserted to block the primary path 64 of permanent bypass whipstock assembly 62. Retrievable diverter 72 is designed to be installed by a simple wireline tool and recovered in a similar manner a latching mechanism, such as a keyhole 73. Diverter 72 includes a sloped top surface which aligns with the desired location of the sidetrack via a sidetrack path 66 whereby tools inserted through tailpipe 26 are deflected onto sidetrack path 66. Preferably, sidetrack path 66 is a gently sloped path with a circular cross section to provide stability for any tools or rotating equipment to be restrained while in sidetrack path 66. It is important to recognize that retrievable diverter 73 and permanent bypass whipstock assembly 62 perform completely different functions in the present invention. For example, permanent bypass whipstock assembly 62 allows for complete downhole access when installed, while retrievable diverter 72 eliminates downhole access upon installation of the diverter.

After diverter 72 is inserted, a drill string is directed downhole with a milling bit suited for the slow process of milling through the steel liner 14. Bit pressure should be concentrated on the whipstock surface recognizing that diverter 72 and the corresponding surface of sidetrack path 66 of permanent bypass whipstock assembly 62 will direct the milling drillbit against the location of liner 14 where a window is desired for sidetrack wellbore 60. Once the milling bit has fully opened the window, the drillstring is withdrawn and re-installed with a conventional drillbit to drill sidetrack well 60 to its full depth. Again, diverter 72 and the corresponding surfaces of sidetrack path 66 of permanent bypass whipstock assembly 62 direct the conventional drillbit to and through the window to form sidetrack 60. Likewise, bit pressure may be applied to the whipstock assembly. Any portion of the diverter that encounters drilling loads should be completely separate than the portion of the diverter containing the retrieval mechanism. In an embodiment, the diverter experience limited drilling loads. In another embodiment of the present invention, only the outer circumference of the diverter experience drilling forces.

Referring now to FIGS. 3 & 4, when sidetrack well 60 is completely formed, the drillstring is withdrawn and a liner pipe 80 is installed into sidetrack 60 guided downhole by diverter 72 and the corresponding surfaces of sidetrack path 66 of permanent bypass whipstock assembly 62.

Upon completion of formation of sidetrack well 60, including insertion of liner pipe 80 and perforation, if necessary, all of the necessary tools and equipment are removed whereby diverter 72 is retrieved to more fully open up downhole path 64 for further work or production. It is important to recognize that several sidetrack (multilateral) wells can be formed in a single primary wellbore using this technique where several permanent bypass whipstock assemblies are installed at various points in the tailpipe string. Likewise, the sidetrack(s) and existing production can be produced selectively by including a packer and nipple below each permanent bypass whipstock assembly. In an embodiment of the present invention, the production from the sidetrack wellbore is selectively produced by including a packer above the permanent bypass whipstock assembly. In another embodiment, the packer is placed below the permanent bypass whipstock assembly. In yet another embodiment, a packer is placed above the permanent bypass whipstock assembly Furthermore, the production from the sidetrack well of the permanent bypass whipstock assembly may contain multiple exit points.

Permanent bypass whipstock assembly 62 is substantially larger in diameter than tailpipe 26 such that permanent bypass whipstock assembly 62 is in close proximity to liner 14, thereby reducing the clearance between tailpipe 26 and liner 14. As such, the permanent bypass whipstock assembly is essentially restricted from lateral movement inside liner 14 due to their relative diameters or sizes. The permanent bypass whipstock assembly reduces the clearance to no more than is necessary to run an additional permanent bypass whipstock assembly and/or packer assembly into the liner, thus eliminating the need for cement by placing the permanent bypass whipstock assembly in close proximity to the liner wall for a single string exit. Furthermore, by eliminating the need for cement, the original production below the tailpipe can be produced.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A process for drilling a sidetrack wellbore from a tailpipe through a liner pipe and into a desired formation, wherein the process comprises:

a. incorporating a permanent bypass whipstock assembly into a section of a length of a tailpipe, wherein said permanent bypass whipstock assembly has an elongated generally cylindrical body, and within a middle section of said permanent bypass whipstock assembly, a primary path and a deviating sidetrack path, wherein said primary path extends from a first end and a second end and allowing complete access to production below the permanent bypass whipstock assembly; wherein said deviating sidetrack path has a downhole end along a peripheral side of said permanent bypass whipstock assembly and a uphole end closer to the first end of and open to said primary path of said permanent bypass whipstock assembly, wherein said tailpipe is releasably connected to the first and second ends of the primary path; wherein said permanent bypass whipstock assembly has a larger diameter than said tailpipe;

b. installing said permanent bypass whipstock and tailpipe into a production assembly;

c. introducing said production assembly inside a liner in a wellbore wherein said permanent bypass whipstock assembly is in proximity to said liner eliminating the need for cement, wherein said primary path of said permanent bypass whipstock assembly is slightly offset from an axis of said liner to create the larger diameter of the permanent bypass whipstock assembly as compared to the tailpipe, wherein said deviating sidetrack path diverges from said primary path at an incline to ultimately form the sidetrack wellbore, wherein the permanent bypass whipstock assembly reduces the clearance to no more than is necessary to run an additional permanent bypass whipstock assembly, a packer assembly or combinations thereof into the liner;

d. positioning said production assembly into a wellbore with the deviating sidetrack path of the permanent bypass whipstock assembly aligned in a predetermined direction for forming the sidetrack well which may later be drilled;

e. sealing said wellbore with said production assembly;

f. installing a diverter, wherein the diverter closes said primary path below the desired location of said sidetrack well, wherein the diverter is installed independent of the permanent bypass whipstock assembly, wherein said diverter directs tools from the primary path to said deviating sidetrack path, wherein the diverter is retrievable;

g. installing a milling system, wherein the milling system includes a milling bit at the downhole end of a drill string whereby when the milling system reaches the diverter the milling system is deflected onto said deviating sidetrack path and continues along the deviating sidetrack path whereby the milling system forms a window in the liner;

h. removing the milling system;

i. installing a drill system, wherein the drill system includes a drillbit located at the downhole end of a drill string, wherein the drill system runs through the primary path and through the permanent bypass whipstock assembly whereby the drill system is diverted onto the deviating sidetrack path by the diverter whereby the drill system reaches the window formed in the liner by the milling system;

j. drilling a sidetrack wellbore with the drill system;

k. removing the drill system; and l. installing a liner pipe casing into the sidetrack wellbore, wherein the liner pipe is run down said primary path and through said permanent bypass whipstock assembly whereby said liner pipe is diverted onto the deviating sidetrack path by the diverter, wherein the liner pipe casing substantially supports the formation exposed by the window, wherein said permanent bypass whipstock assembly is permanently installed in said wellbore.

2. The process according to claim 1, further including the step of removing the diverter to fully open the primary path to the section of tailpipe below the permanent bypass whipstock assembly.

3. The process according to claim 1, wherein production from the sidetrack wellbore is selectively produced.

4. The process according to claim 3, wherein the production from the sidetrack wellbore is selectively produced by including a packer to isolate production.

5. The process according to claim 4, wherein the packer is above the permanent bypass whipstock assembly.

6. The process according to claim 4, wherein there are multiple paths below the packer.

7. A process for drilling a sidetrack wellbore from a tailpipe through a liner pipe and into a desired formation, wherein the process comprises:

a. incorporating a permanent bypass whipstock assembly into a section of a length of a tailpipe as part of a production assembly, wherein within a middle section of said permanent bypass whipstock assembly is a primary path and a deviating sidetrack path, wherein said primary path allows for complete access to production below the permanent bypass whipstock assembly; wherein said deviating sidetrack path diverges from said primary path at an incline to ultimately form the sidetrack wellbore wherein said permanent bypass whipstock assembly has a larger diameter than said tailpipe;

b. installing said production assembly inside a liner in a wellbore with the deviating sidetrack path of the permanent bypass whipstock assembly aligned in a predetermined direction for forming the sidetrack well that may later be drilled, wherein said primary path of said permanent bypass whipstock assembly is slightly offset from an axis of said liner to create the larger diameter of the permanent bypass whipstock assembly as compared to the tailpipe and a close proximity of the permanent bypass whipstock assembly to said liner, wherein the permanent bypass whipstock assembly reduces a clearance between said liner and said permanent bypass whipstock assembly to no more than is necessary to run an additional permanent bypass whipstock assembly, a packer assembly or combinations thereof into the liner;

c. installing a diverter to close the primary path below a desired location of the sidetrack path, wherein the diverter is installed independent of the permanent bypass whipstock assembly;

d. installing a milling system;

e. milling the liner with the milling system;

f. removing the milling system;

g. installing a drill system;

h. drilling a sidetrack wellbore with the drill system at said deviating sidetrack path;

i. removing the drill system; and j. installing a liner pipe casing into the sidetrack wellbore, wherein the liner pipe casing substantially supports the formation exposed by the window.

8. The process according to claim 7, wherein the permanent bypass whipstock assembly has an elongated generally cylindrical body.

9. The process according to claim 7, wherein the tailpipe is releasably connected to a first end and a second end of the primary path through the permanent bypass whipstock assembly.

10. The process according to claim 7, wherein a downhole end of the deviating sidetrack path is along a peripheral side of the permanent bypass whipstock assembly.

11. The process according to claim 7, wherein the permanent bypass assembly is permanently installed.

12. The process according to claim 7, wherein the diverter directs tools from the primary path within the permanent bypass whipstock assembly to the sidetrack path of the permanent bypass whipstock assembly.

13. The process according to claim 7, further including the step of removing the diverter to fully open the primary path to the section of tailpipe below the permanent bypass whipstock assembly.

14. The process according to claim 7, wherein the milling system includes a milling bit at the downhole end of a drill string whereby when the milling system reaches the diverter the milling system is deflected onto the deviating sidetrack path and continues along the sidetrack path whereby the milling system forms a window in the liner.

15. The process according to claim 7, wherein the drilling system includes a drillbit located at the downhole end of a drill string.

16. The process according to claim 7, wherein the drilling system is run through the primary path through the permanent bypass whipstock assembly and is diverted onto the deviating sidetrack path by the diverter whereby the drill system forms a window in the liner.

17. The process according to claim 7, wherein production from the sidetrack wellbore is selectively produced.

18. The process according to claim 17, wherein the production from the sidetrack wellbore is selectively produced by including a packer to isolate production.

19. The process according to claim 18, wherein the packer is above the permanent bypass whipstock assembly.

20. The process according to claim 18, wherein there are multiple paths below the packer.

21. A permanent bypass whipstock assembly for forming a sidetrack wellbore, wherein the permanent bypass whipstock assembly comprises:

a. an elongated cylindrical body installed inside a liner in a wellbore, wherein the elongated cylindrical body includes a first end and a second end, wherein the first end is connected to an uphole end of a tailpipe and the second end is connected to a downhole end of the tailpipe, wherein the elongated cylindrical body has a larger diameter than the tailpipe, wherein the elongated cylindrical body is in close proximity to the liner eliminating the need for cement, wherein the elongated cylindrical body includes:

i. a primary path running through the elongated cylindrical body, wherein a middle section of the primary path is slightly offset from an axis of the liner, whereby the primary path is further defined by a thin-walled portion and a thick walled portion within the section of offset, wherein the primary path allows complete access to production below the permanent bypass whipstock assembly;

ii. a deviating sidetrack path for forming a sidetrack wellbore diverges from the primary path, wherein the deviating sidetrack path diverges from the primary path at an incline, wherein the uphole end of the deviating sidetrack path is closer to the first end of the permanent bypass whipstock assembly and opens to the primary path of the permanent bypass whipstock assembly, wherein the downhole end of the deviating sidetrack path is along a peripheral side of the permanent bypass whipstock assembly;

iii. wherein the thin-walled portion is elongated and runs the entire downhole length of the permanent bypass whipstock assembly, whereby an interior surface defines the primary path and an exterior surface is in close proximity with a liner within the section of offset of the primary path; and iv. the thick-walled portion includes:

a) a stabilizing portion, wherein the stabilizing portion is a wedge shaped inverted trough defined by the deviating sidetrack path, wherein an interior surface of the stabilizing portion defines the primary path and an exterior surface of the stabilizing portion is in close proximity with the liner; and b) a deflector portion, wherein the deflector portion is wedge shaped with an inclined surface defining the lower portion of the deviating sidetrack path, wherein an interior surface of the deflector further defines the primary path and an exterior surface of the deflector is in close proximity with the liner.

22. The permanent bypass whipstock assembly according to claim 21, wherein the permanent bypass whipstock assembly is made of steel.

* * * * *